US007497431B2

(12) United States Patent
Takai et al.

(10) Patent No.: US 7,497,431 B2
(45) Date of Patent: Mar. 3, 2009

(54) PNEUMATIC TYPE PAPER FEEDING APPARATUS

(75) Inventors: Shingo Takai, Ibaraki (JP); Yasushi Hashimoto, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 427 days.

(21) Appl. No.: 11/041,936

(22) Filed: Jan. 26, 2005

(65) Prior Publication Data

US 2005/0184446 A1 Aug. 25, 2005

(30) Foreign Application Priority Data

Feb. 24, 2004 (JP) ..... P 2004-047238

(51) Int. Cl.
*B65H 3/14* (2006.01)
*B65H 3/08* (2006.01)

(52) U.S. Cl. ..... 271/97; 271/98; 271/108; 137/625.46

(58) Field of Classification Search ..... 271/90, 271/5, 9.01, 108, 97, 98; 137/625.46
See application file for complete search history.

(56) References Cited

U.S. PATENT DOCUMENTS

| | | | | |
|---|---|---|---|---|
| 1,697,752 | A | 1/1929 | Broadmeyer | |
| 2,233,935 | A * | 3/1941 | Backhouse | 271/93 |
| 2,402,442 | A | 6/1946 | Perry | |
| 3,069,025 | A * | 12/1962 | Winkler et al. | 414/737 |
| 3,294,396 | A | 12/1966 | Staines | |
| 3,884,460 | A * | 5/1975 | Jiruse | 271/98 |
| 4,320,893 | A * | 3/1982 | Blumle | 271/94 |
| 4,403,770 | A * | 9/1983 | Ferguson et al. | 270/52.24 |
| 5,090,676 | A * | 2/1992 | Matsuno et al. | 271/12 |
| 5,480,137 | A * | 1/1996 | Haupenthal | 271/276 |
| 5,685,534 | A * | 11/1997 | Zeltner | 271/108 |

(Continued)

FOREIGN PATENT DOCUMENTS

| | | |
|---|---|---|
| DE | 1036811 | 4/1955 |

(Continued)

OTHER PUBLICATIONS

German Office Action dated May 30, 2006 (with English language translation.)

*Primary Examiner*—Patrick H Mackey
*Assistant Examiner*—Luis Gonzalez
(74) *Attorney, Agent, or Firm*—McGinn IP Law Group, PLLC

(57) ABSTRACT

An air current distributing apparatus includes: a cylinder having a first air port communicated with a supply source of an air current and also having a second, a third, a fourth and a fifth air port respectively communicated with an injection port of the air current; a main rotor rotated in the cylinder; and a subrotor rotated in the cylinder, wherein the main rotor has a cutout portion for selectively communicating the first air port with at least one of the second and the third air port according to the rotary position, and the subrotor has a cutout portion for selectively communicating the first air port with at least one of the fourth and the fifth air port according to the rotary position. When the air current distributing apparatus is used, a plurality of air currents are formed by one blower.

6 Claims, 8 Drawing Sheets

U.S. PATENT DOCUMENTS

| | | | | |
|---|---|---|---|---|
| 6,254,082 | B1 * | 7/2001 | Sugimoto et al. | 271/108 |
| 6,497,250 | B1 * | 12/2002 | Johann | 137/625.46 |
| 7,255,130 | B2 * | 8/2007 | Martins et al. | 137/625.46 |
| 2004/0075209 | A1 * | 4/2004 | Horiuchi | 271/98 |

FOREIGN PATENT DOCUMENTS

| | | |
|---|---|---|
| DE | 84 37 975 U1 | 12/1984 |
| DE | 195 12 313 C1 | 4/1995 |
| JP | 2934442 | 5/1999 |
| JP | 2002-169450 | 6/2002 |

* cited by examiner

PNEUMATIC TYPE PAPER FEEDING APPARATUS

BACKGROUND OF THE INVENTION

1. Field of the Invention

The present invention relates to a paper feeding apparatus for an electrophotographic apparatus such as a copying machine and printer, and more specifically relates to the paper feeding apparatus that separates and feeds sheets of paper by air flow.

2. Description of the Related Art

An example of the conventional paper feeding device used for an electrophotographic apparatus, which is referred to as an air suction type or air separation type paper feeding device, is shown in FIG. 1.

In FIG. 1, sheets of paper 2 stacked on the paper elevating table 1 are controlled to be located at a constant height at all times by the paper upper face detection sensor 3 and the control member 4 for controlling the paper elevating table 1 according to information sent from the paper upper face detection sensor 3. The vacuum and air charging chamber 5, the belt member 6 having suction holes and the drive unit 7 for driving the belt member 6 are arranged in an upper portion of the sheets of paper 2. On the front face of the sheets of paper in the conveyance direction, the air injection nozzles 8 are provided so that the sheets of paper in the upper layer portion of the stacked sheets of paper can be separated from each other when air is blown, and the sheets of paper are floated. The sheet of paper 2 which has floated by the air injection nozzles 8 is sucked and conveyed by the belt member 6. In this way, paper feeding is conducted. In the downstream of the flow of the sheets of paper in the conveyance direction, the sheet conveyance member, which is a so-called conveyance roller 9, is provided which receives the sheet of paper 2, which is sucked and conveyed by the belt member 6, and conveys it to an image forming section not shown in the drawing.

In the paper feeding device composed as described above, in order to positively and quickly separate and float the sheet of paper by a current of air and convey it to the image forming section, various proposals have been conventionally made.

For example, in the official gazette of Japanese Patent No. 2934442, the paper separating and supplying device illustrated in FIGS. 2 and 3 is disclosed. This device can provide the following advantages. As shown in FIGS. 2 and 3, in addition to the air injection nozzles 8 for separating and floating the sheets of paper 2 when a current of air is blown to them, the second nozzles 10 for injecting air to the side of sheets of paper with respect to the conveyance direction of the sheets of paper 2 are provided so that the floating effect of the sheets of paper 2 can be enhanced.

However, the above structure has the following disadvantages. When the sheets of paper are thick and difficult to be floated by a current of air, the above structure is advantageous. On the other hand, when the sheets of paper are thin, for example, in the case of tracing paper, the thickness of which is small, the sheets of tracing paper are extremely floated and a large number of sheets of tracing paper are supplied at one time. Therefore, according to the type of paper, it is necessary to prepare a mode, in, which a current of air is injected from the front, and a mode in which currents of air are injected from both the front and the side. When necessary, the current of air must be switched.

Concerning the device for supplying air to the air injection nozzles 8, 10 and supplying and discharging air from the vacuum and air charging chamber 5, a fan or blower is commonly used. In general, in the case of an electrophotographic apparatus such as a copying machine or printer, a plurality of paper feeding devices are arranged in many cases. Therefore, the number of fans or blowers is increased, which raises the manufacturing cost.

A system in which a plurality of fans, which are used in the conventional image forming apparatus, are reduced to one or a small number is disclosed in the official gazette of JP-A-2002-169450. However, in any case, it is necessary to provide a plurality of distributing devices for distributing a current of air, which has been supplied from one set of fan or blower, to a plurality of passages or nozzles.

Further, in the case of the paper feeding device shown in FIGS. 2 and 3 in which air is injected in two directions, one is a direction to the front of the sheets of paper 2 and the other is a direction to the side of the sheets of paper 2, in order to control the current of air in the two directions, it is necessary to provide air supplying units which are respectively independent from each other. Alternatively, it is necessary to provide a distributing device for switching the current of air. As a result, the manufacturing cost of the entire device is increased.

SUMMARY OF THE INVENTION

In order to solve the above conventional problems, it is an object of the invention to provide a paper feeding device on an electrophotographic apparatus having a plurality of air injection nozzles is mounted, or in an electrophotographic apparatus on which a plurality of pneumatic type paper feeding apparatus are mounted, when an air current distributing device is arranged which is capable of forming a plurality of air currents by one set of fan or blower, it is possible to provide an air type paper feeding device and an electrophotographic apparatus at a low manufacturing cost.

In order to accomplish the above object, a pneumatic type paper feeding apparatus for supplying sheets of paper for printing to an electrophotographic apparatus, comprising: a paper floating member having a first injection nozzle and a second injection nozzle for respectively injecting a current of air to the sheets of paper from different places so as to convey the sheets of paper; a conveyance member for conveying the floated sheets of paper; and a distributing member for supplying a current of air to the first and the second injection nozzle, the distributing member being provided in an air supply passage, and the distributing member including: a cylindrical member having a first air port and a second air port communicated with passages connected to the first and the second injection nozzle and also having a third air port communicated with the air supply passage; and a rotor pivotally inserted into the cylindrical member, wherein it is possible to change over between an operation mode, in which the third air port is communicated with the first or the second air port, and an operation mode, in which the third air port is communicated with the first and the second air port, according to a rotary position of the rotor.

According to another aspect of the present invention, an electrophotographic apparatus comprises: a first paper feeding device and a second paper feeding device respectively having a sheet floating member for floating sheets of paper by a current of air injected from injection nozzles and also having a conveyance member for conveying the floated sheets of paper, wherein the sheets of paper are selectively supplied from the first and the second paper feeding device; and a distributing member arranged between a first and a second air passage for supplying air to the first and the second paper feeding device, and a third passage connected to an air supply source, and the distributing member including: a cylindrical member having a first and a second air port communicated with the first and the second passage and also having a third air port communicated with the third air passage; and a rotor pivotally inserted into the cylindrical member, wherein it is possible to change over between an operation mode, in which the third air port is communicated with the first air port, and an operation mode, in which the third air port is communicated with the second air port, according to a rotary position of the rotor.

According to still another aspect of the present invention, an air current distributing device comprises: a cylinder portion; and a rotor portion pivotally inserted into the cylinder portion, wherein the cylinder portion includes a first air port communicated with an air current supply source and a second, third, fourth and fifth port communicated with an injection port of the current of air, the rotor portion includes a main rotor and a subrotor, the main rotor includes a cutout portion for selectively communicating the first air port with the second or the third air port according to the rotary position of the main rotor, and the subrotor includes a cutout portion for selectively communicating the first air port with the fourth or the fifth air port according to the rotary position of the subrotor.

According to still another aspect of the present invention, the main rotor and the subrotor are connected with each other by a torque limiter, and the subrotor is idled when the main rotor is rotated by an angle not less than a predetermined angle.

According to still another aspect of the present invention, the subrotor can be rotated only by a predetermined angle range when a groove is formed on the side of the subrotor by a predetermined angle range and a member engaged with the groove is provided in the cylinder.

According to still another aspect of the present invention, an air current distributing device includes: a first operation mode in which the first air port is communicated with only the second air port; a second operation mode in which the first air port is communicated with only the third air port; a third operation mode in which the first air port is communicated with the second and the fourth air port; and a fourth operation mode in which the air port is communicated with the third and the fifth air port, wherein the first to the fourth mode can be selectively changed over.

According to still another aspect of the present invention, an intermediate mode, in which the first air port and the atmosphere are communicated with each other, is formed between at least two modes of the first to the fourth operation mode.

According to still another aspect of the invention, a distributing device is provided between a blower for supplying air and a plurality of injection nozzles for injecting a current of air used for feeding sheets of paper. This distributing device includes: a cylinder having a plurality of air ports communicated with a plurality of nozzles and also having an air port communicated with the blower; and a rotor pivotally inserted into the cylinder and having a cutout portion selectively communicated with the air port according to a rotary position. Therefore, even when a small number of fans, blowers or distributing devices are used, it is possible to change over a current of air. Accordingly, the manufacturing cost are reduced.

DESCRIPTION OF THE PREFERRED EMBODIMENTS

The most preferred embodiment of the present invention will be explained as follows.

Embodiment

Figure 1:
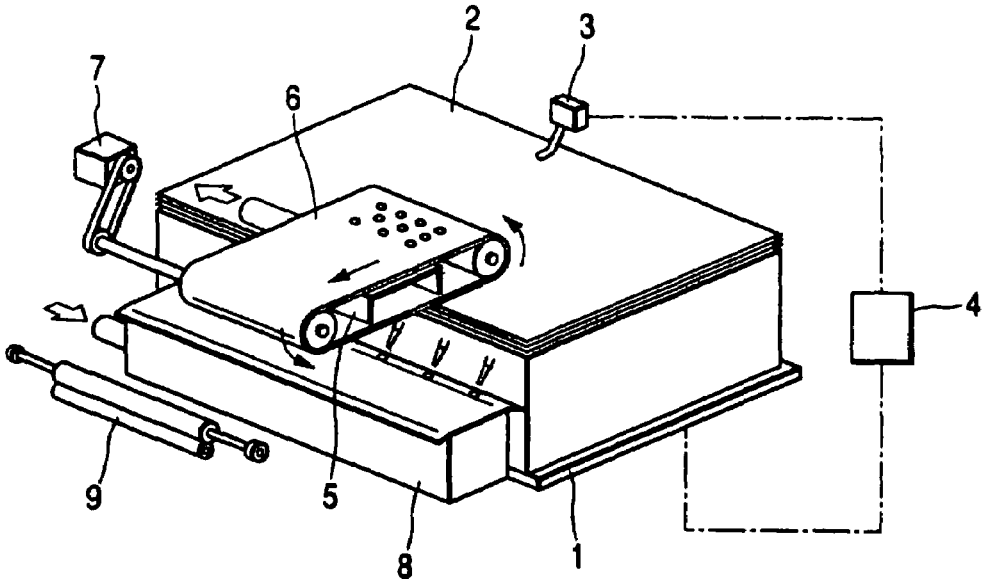
FIG. 1 RELATED ART
FIG. 1 is a perspective view showing a conventional example of the paper supplying device in which a current of air is used.
Figure 2:
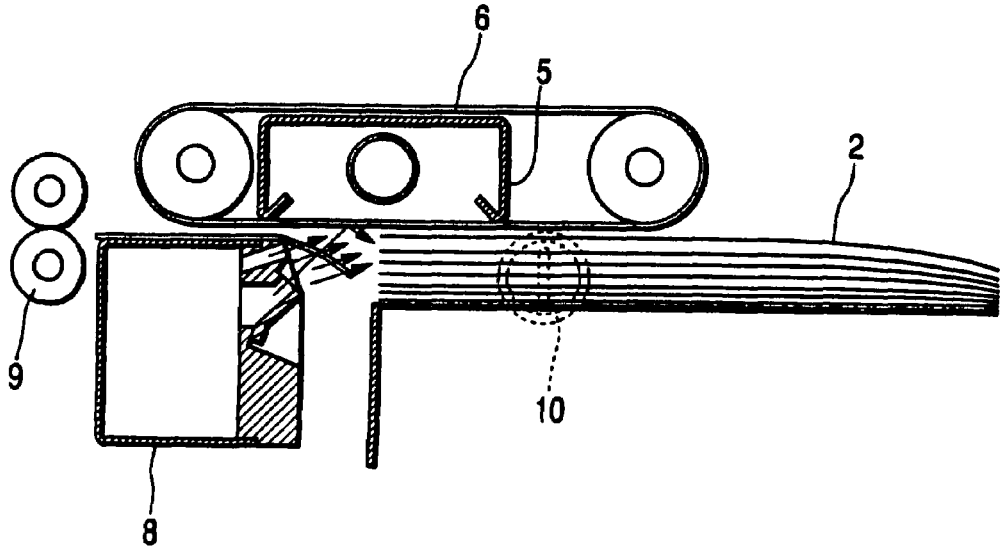
FIG. 2 RELATED ART
FIG. 2 is a sectional view showing a conventional example of the paper supplying device in which a current of air is used.
Figure 3:
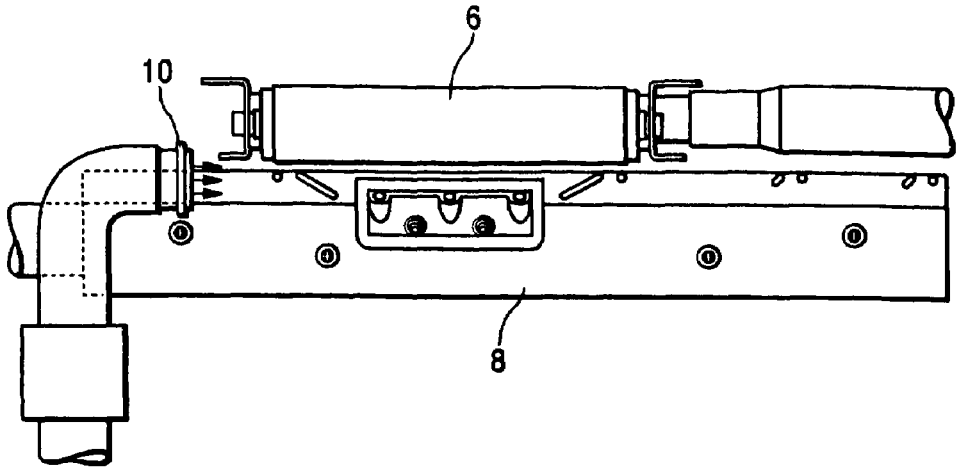
FIG. 3 RELATED ART
FIG. 3 is a front view showing a conventional example of the paper supplying device in which a current of air is used.
Figure 4:
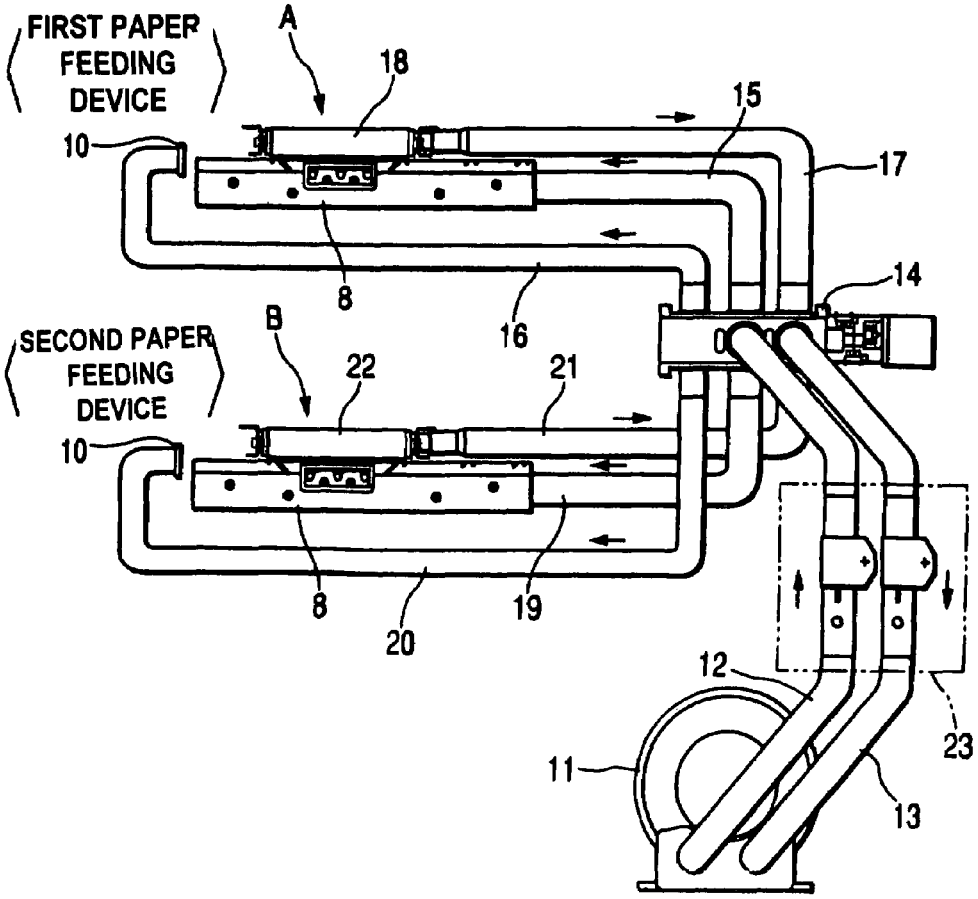
FIG. 4 is a schematic arrangement view showing an embodiment of the present invention of the pneumatic type paper supplying device.

FIG. 4 is a view showing an embodiment of the pneumatic type paper feeding apparatus of the present invention. The pneumatic type paper feeding apparatus includes: a first paper feeding device A having a first air injection nozzle 8 and a second air injection nozzle 10; a second paper feeding device B having two nozzles 8, 10 in the same manner as that of the first paper feeding device A; and a single blower 11.

A current of air sent from the blower 11 is supplied to the adjustment valve 23 via the duct 12 for injecting air so that the injection pressure of the current of air can be adjusted. After that, the current of air is supplied to the distributing device 14.

The distributing device 14 is connected with the ducts 15, 16 for supplying currents of air to the front injection nozzle 8 and the side injection nozzle 10 of the first paper feeding device A and also connected with the ducts 19, 20 for supplying currents of air to the front injection nozzle 8 and the side injection nozzle 10 of the second paper feeding device B. Discharge air discharged from the suction conveyance device 18 of the first paper feeding device A is introduced to the distributing device 14 via the air discharge duct 17, and discharge air discharged from the suction conveyance device 22 of the second paper feeding device B is introduced to the distributing device 14 via the air discharge duct 21. Discharge pressure of both currents of discharge air described above is adjusted by the adjustment valve 23, and then discharge air is introduced to the blower 11 via the air discharge duct 13.

In this embodiment, when printing is conducted by an electrophotographic apparatus, into which the above pneumatic type paper feeding apparatus is incorporated, the following four operation modes A, B, C and D are selectively and handily changed over.

Mode A is described as follows.

The first paper feeding device A is used, and air is injected from the front injection nozzle 8 arranged in the paper conveyance direction.

Mode B is described as follows.

The first paper feeding device A is used, and air is injected from both the front injection nozzle 8 and the side injection nozzle 10 arranged in the paper conveyance direction.

Mode C is described as follows.

The second paper feeding device B is used, and air is injected from the front injection nozzle 8 arranged in the paper conveyance direction.

Mode D is described as follows.

The second paper feeding device B is used, and air is injected from both the front injection nozzle 8 and the side injection nozzle 10 arranged in the paper conveyance direction.

Next, referring to FIGS. 5 to 9, the specific structure to realize the above operation modes A, B, C and D will be explained below.

Figure 5:
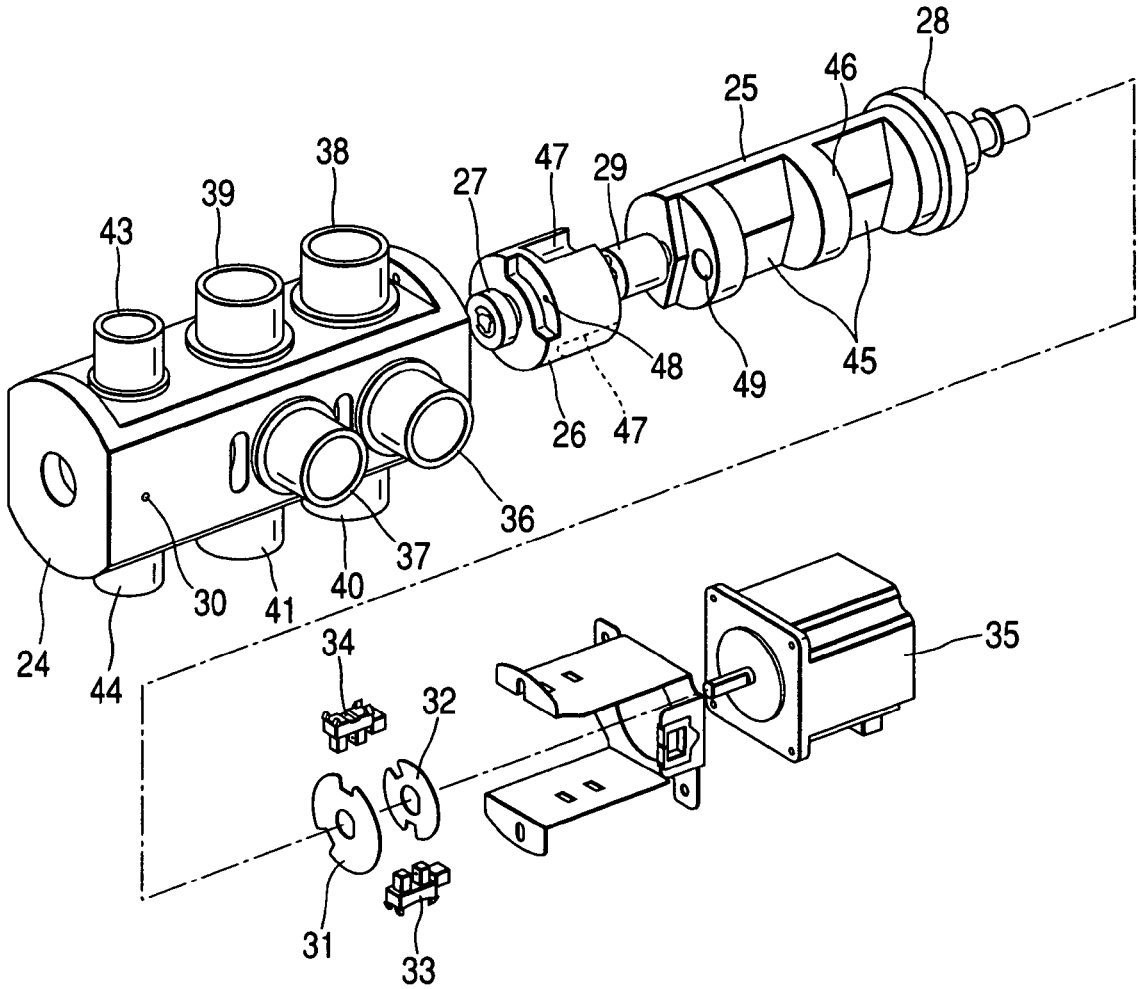
FIG. 5 is an exploded view showing an arrangement of an embodiment of the distributing device used for the pneumatic type paper supplying device.

FIG. 5 is an exploded view showing an embodiment of the distributing device used for the pneumatic type paper feeding apparatus. The distributing device mainly includes: a cylinder 24; a main rotor 25 pivotally inserted into the cylinder 24; a subrotor 26; and a step motor 35 for rotating the main rotor 25 and the subrotor 26.

In the cylinder 24, the air ports 36, 37 are provided on the side, the air ports 38, 39, 43 are provided on the upper face, and the air ports 40, 41, 44 are provided on the lower face. The air port 36 is connected to the air discharge duct 13 shown in FIG. 4, and the air port 37 is connected to the air injection duct 12. The air ports 38, 39, 43 are respectively connected to the air discharge duct 17, the front injection nozzle duct 15 and the side injection duct 16.

On the other hand, the air ports 40, 41, 44 are respectively connected to the air discharge duct 21, the front injection nozzle duct 19 and the side injection duct 20 shown in FIG. 4. In this embodiment, the air ports 36, 37 make a right angle with the other air ports 38, 39, 43. The air ports 36, 37 also make a right angle with the other air ports 40, 41, 44. On the side of the cylinder 24, the pin 30 for restricting a rotary angle of the rotor 26 is provided.

On the other hand, the main rotor 25 and the subrotor 26 are inserted into the cylinder 24 and pivotally supported by the ball bearings 27, 28, which are provided on both end portions, so that the main rotor 25 and the subrotor 26 can be rotated in the cylinder 24.

In the main rotor 25, the cutout portions 45 partitioned by the partition plate 46 are provided. These cutout portions 45 are formed by a predetermined angle with respect to the rotary shaft. When these cutout portions 45 come to between the air ports 36, 37 and the air ports 38, 39, an air supply passage and an air discharge passage are formed between the blower 11 and the first paper feeding device A shown in FIG. 4. When the above cutout portions 45 come to between the air ports 36, 37 and the air ports 40, 41, an air supply passage and an air discharge passage are formed between the blower 11 and the second paper feeding device B shown in FIG. 4. Since the partition plate 46 is provided between the air supply passage and the air discharge passage, the supply air and the discharge air are not mixed with each other.

On one side of the main rotor 25, the through-hole 49 is provided and used when the air which has entered from the air port 37 is distributed to the air ports 43 and 44. On the other hand, in the subrotor 26, two cutout portions 47, which are parallel to the rotary shaft, are provided on the outer circumferential face. In this embodiment, these cutout portions 47 are arranged at symmetrical positions with respect to the rotary shaft, that is, these cutout portions 47 are arranged at the interval of 180.

On the side of the subrotor 26, the groove 48 engaged with the pin 30 is provided. In this embodiment, this groove 48 is restricted by the rotary angle 90. of the subrotor 26. When the subrotor 26 is at a predetermined rotary position, after air has entered from the air port 37, it is supplied to the air port 43 or 44 via the cutout portion 47.

The torque limiter 29 is connected between the subrotor 26 and the main rotor 25. When the main rotor 25 is rotated in the angle range of 90., the subrotor 26 follows the main rotor 25. However, when the main rotor 25 is rotated by an angle exceeding 90., since the rotation of the subrotor 26 is restricted by the rotary pin 30, the subrotor 26 can not follow the main rotor 25. Therefore, the subrotor 26 idles.

The disk-shaped actuators 31, 32 respectively having a pair of cutout portions at the circumferential edge portions are attached to the rotary shaft of the main rotor 25. The optical sensors 33, 34 are provided close to these actuators 31, 32. Positions of four patterns in total can be detected by the pair of cutout portions and the optical sensors 33, 34. Due to the foregoing, the main rotor 25 can be stopped at an arbitrary rotary position in the operation modes A, B, C and D.

Next, the relation of the rotary position between the cylinder 24 and the rotors 25, 26 in the above operation modes A, B, C and D will be explained below.

(1) Operation Mode A

Figure 6:
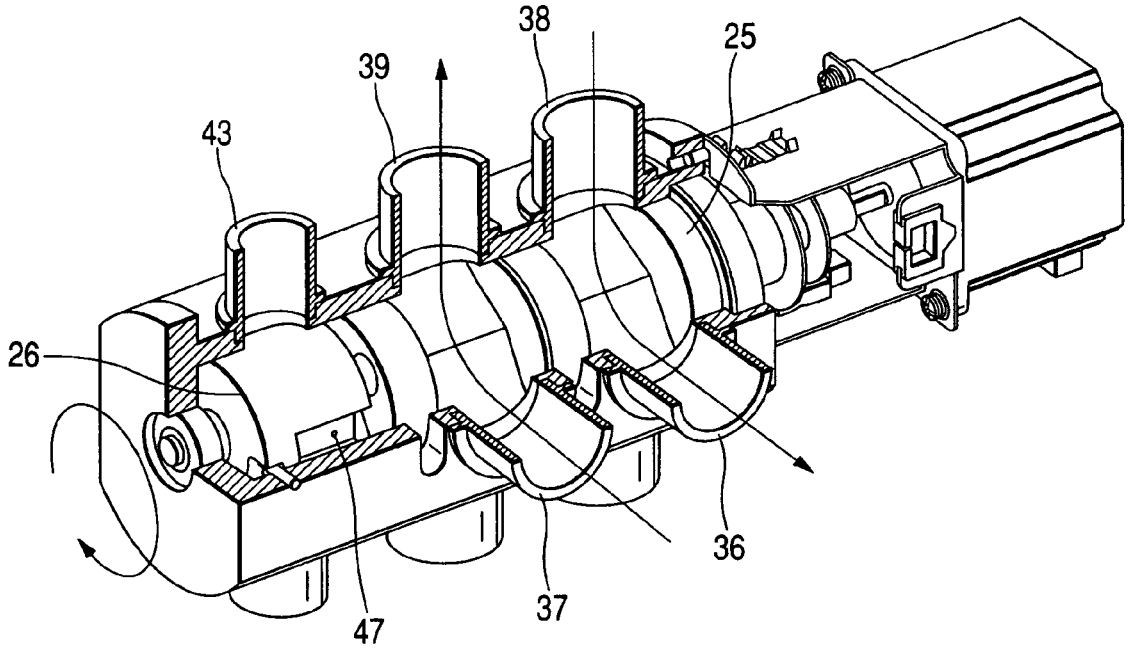
FIG. 6 is a schematic illustration for explaining an operation mode of the distributing device used for the embodiment of the present invention.

In the operation mode A, the first paper feeding device A is used, and air is injected from the injection nozzle 8 on the front face in the paper conveyance direction. In this case, as shown in FIG. 6, the main rotor 25 is rotated clockwise by an angle not less than 90. and then stopped at a position where the air ports 36, 37 respectively communicated with the air ports 38, 39. Since the cutout portion 47 of the subrotor 26 does not agree with the air port 43 at this time, no current of air flows from the air port 37 to the air port 43.

(2) Operation Mode B

Figure 7:
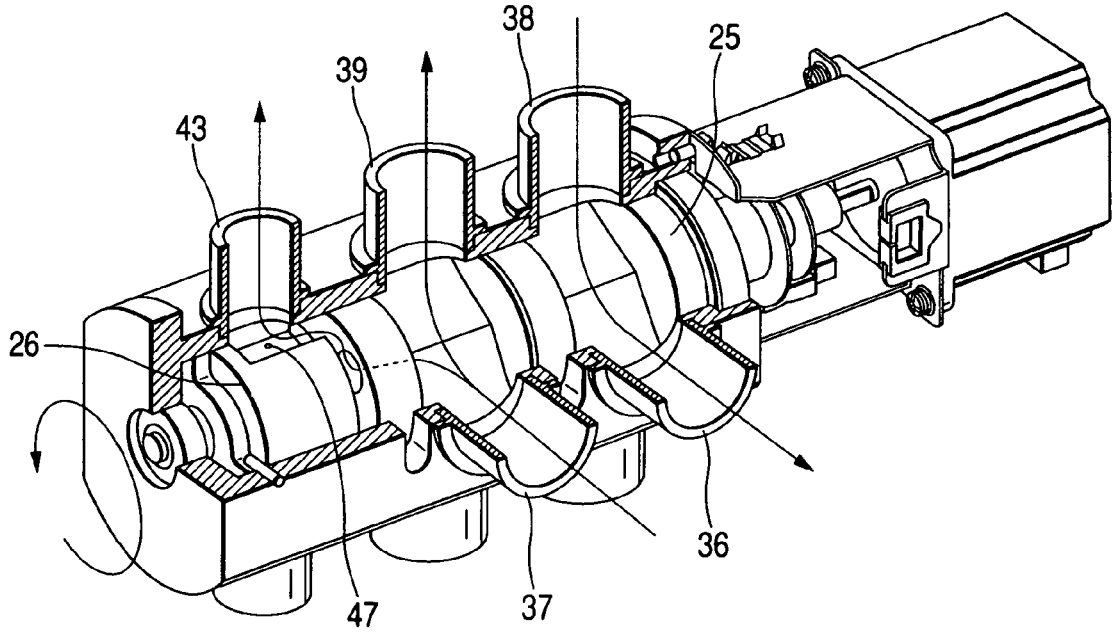
FIG. 7 is a schematic illustration for explaining an operation mode of the distributing device used for the embodiment of the present invention.

In the operation mode B, the first paper feeding device A is used, and air is injected from two nozzles, wherein one is the injection nozzle 8 on the front face in the paper feeding direction, and the other is the injection nozzle 10 on the side in the paper feeding direction. In this case, as shown in FIG. 7, the main rotor 25 is rotated counterclockwise by an angle not less than 180 and then stopped at a position where the air ports 36, 37 are respectively communicated with the air ports 38, 39. At this time, the cutout portion 47 of the subrotor 26 coincides with the air port 43, and a current of air sent from the air port 37 is supplied to both the air port 39 and the air port 43 via the hole 49 of the main rotor 25.

(3) Operation Mode C

Figure 8:
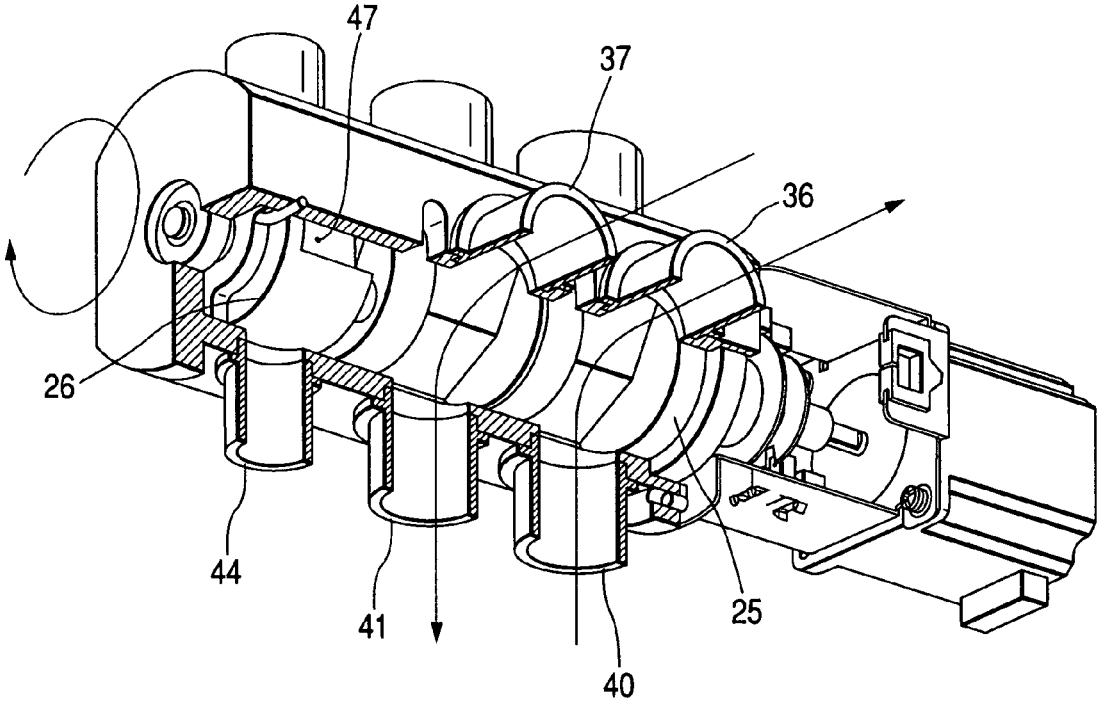
FIG. 8 is a schematic illustration for explaining an operation mode of the distributing device used for the embodiment of the present invention.

In the operation mode C, the second paper feeding device B is used, and air is injected from the injection nozzle 8 on the front face in the paper conveyance direction. In this case, as shown in FIG. 8, the main rotor 25 is rotated clockwise by an angle not less than 180 and then stopped at a position where the air ports 36, 37 respectively communicated with the air ports 40, 41. Since the cutout portion 47 of the subrotor 26 does not agree with the air port 44 at this time, no current of air flows from the air port 41 to the air port 44.

(4) Operation Mode D

Figure 9:
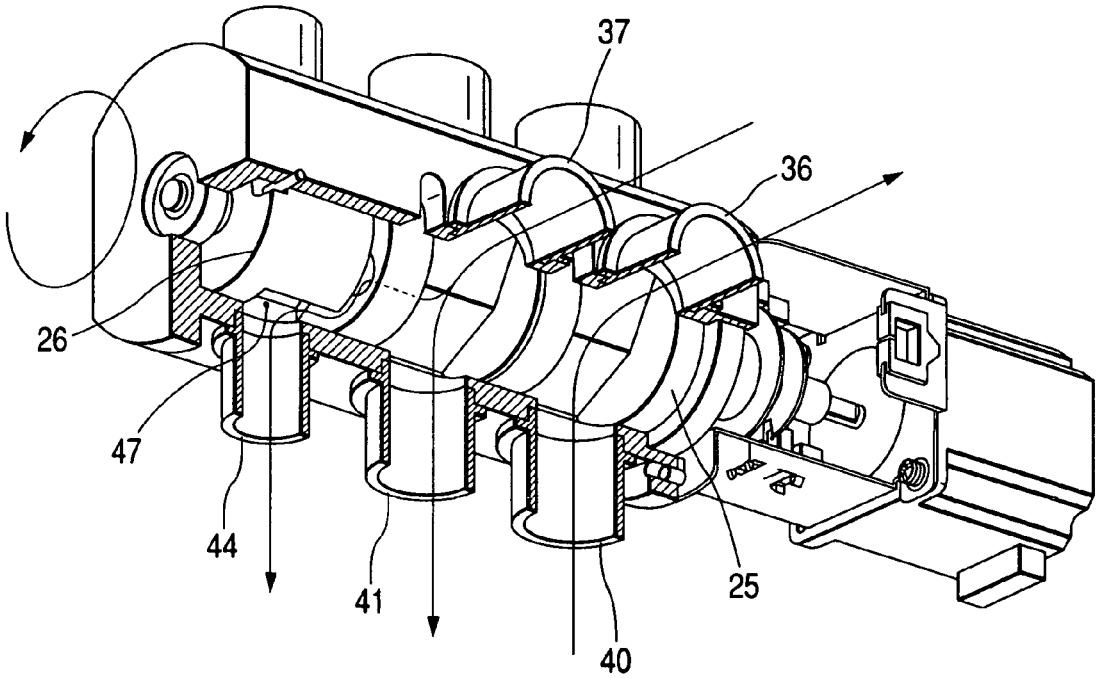
FIG. 9 is a schematic illustration for explaining an operation mode of the distributing device used for the embodiment of the present invention.

In the operation mode D, the second paper feeding device B is used, and air is injected from two nozzles, wherein one is the injection nozzle 8 on the front face in the paper feeding direction, and the other is the injection nozzle 10 on the side in the paper feeding direction. In this case, as shown in FIG. 9, the main rotor 25 is rotated counterclockwise by an angle not less than 90. and then stopped at a position where the air ports 36, 37 may be respectively communicated with the air ports 40, 41. At this time, the cutout portion 47 of the subrotor 26 coincides with the air port 44, and a current of air sent from the air port 37 is supplied to both the air ports 41 and the air port 44 via the hole 49 of the main rotor 25.

As described above, according to this embodiment, when one distributing device is used, the pneumatic type paper feeding apparatus is operated by the four operation modes. However, in this embodiment, as described in detail later, when the main rotor 25 is rotated clockwise by the angle 135., the device is set in the operation mode A. When the main rotor 25 is rotated counterclockwise by the angle 225., the device is set in the operation mode B. When the main rotor 25 is rotated clockwise by the angle 225., the device is set in the operation mode C. When the main rotor 25 is rotated counterclockwise by the angle 135., the device is set in the operation mode D. That is, in the operation modes A and B, the positional relations between the disks 31, 32 and the optical sensors 34, 33 become the same. In the operation modes C and D, the positional relations between the disks 31, 32 and the optical sensors 34, 33 become the same. For the above reasons, problems are caused when the rotary position of the main rotor 25 is controlled. Therefore, in this embodiment, when the operation mode is shifted between the operation modes A and B and between the operation modes C and D, the shifting operation is conducted through the neutral mode.

Figure 10:
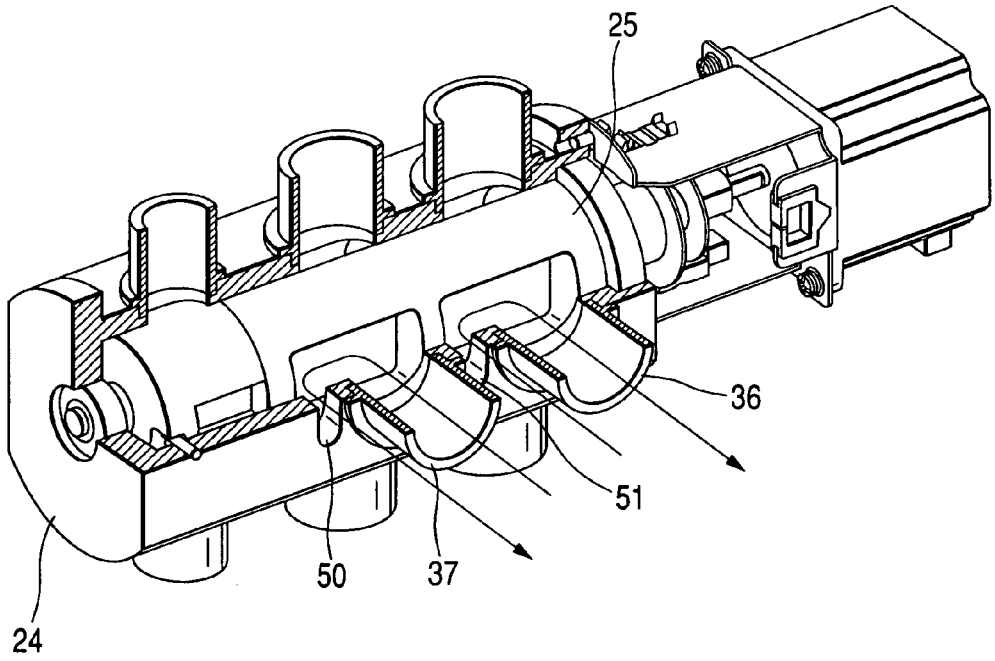
FIG. 10 is a schematic illustration for explaining a neutral operating position of the distributing device used for the embodiment of the present invention.

FIG. 10 is a view showing the structure in which the neutral position is provided. The hole portions 50, 51 are formed at positions adjacent to the air ports 36, 37 on the side of the cylinder 24. When the main rotor 25 is stopped at a predetermined rotary position, the air ports 36, 37 are communicated with the atmosphere through the hole portions 50, 51.

Next, in this embodiment of the present invention, referring to FIGS. 11A to 11C, FIGS. 11D to 11F, FIGS. 12A to 12C and FIGS. 12D to 12F, explanations will be made into the relations between the operation modes and the rotary positions of the sensors 33, 34, the main rotor 25 and the subrotor 26.

Figures 11A, 11B, 11C:
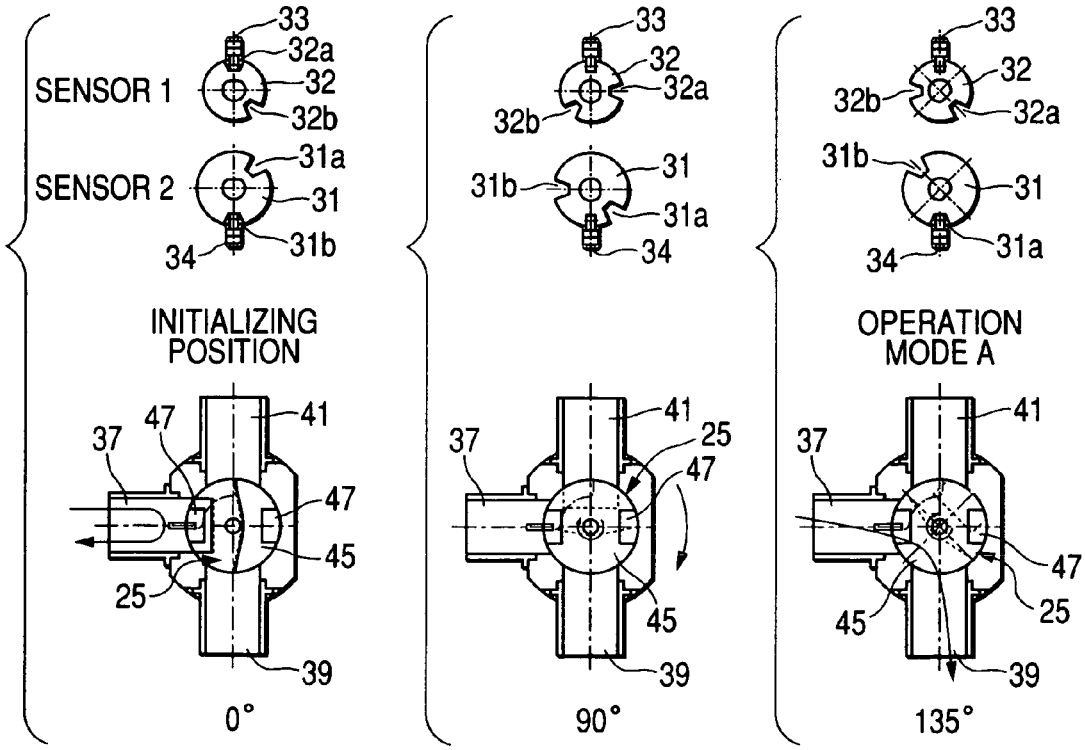
FIGS. 11A to 11C are schematic illustrations for explaining an operation mode of the distributing device used for the embodiment of the present invention.

FIGS. 11A to 11C are views showing positional relations between the main rotor 25, the air ports 37, 39, 41 and the disks 31, 32 in the case where the main rotor 25 is located at the neutral position. For the convenience of explanations, the other air ports 36, 38, 43, 44 are not illustrated in this view, however, when the explanations of FIGS. 6 to 10 are referred, the positional relations will be easily understood.

The detector used for controlling the rotary position of the main rotor 25 includes the disks 31, 32 and the optical sensors 33, 34. The disk 31 has two cutout portions 31*a*, 31*b* on the circumference, and the disk 32 also has two cutout portions 32*a*, 32*b* on the circumference. When the optical sensors 33, 34 are respectively located at positions opposing to the cutout portions of the disks 32, 32, the optical sensors 33, 34 output, for example, ON signals. When the optical sensors 33, 34 are not located at positions opposing to the cutout portions of the disks 32, 32, the optical sensors 33, 34 output OFF signals.

At the neutral position shown in FIG. 11A, the sensors 33, 34 are respectively located at positions opposing to the cutout portions 32*a*, 31*b*, and the cutout portion 45 of the main rotor 25 and the cutout portion 47 of the subrotor are located at positions shown in the drawing. That is, the air port 37 is communicated with neither the air port 39 nor the air port 41 by the cutout portion 45 of the main rotor 25. Due to the engagement of the pin 30 with the groove 48 shown in FIG. 5, the cutout portion 47 of the subrotor is not rotated clockwise. When the main rotor 25 is rotated counterclockwise from the neutral position, the cutout portion 47 is also rotated counterclockwise by the angle 90.. However, even when the main rotor 25 is rotated more than that, the cutout portion 47 is fixed at the same position.

When the positional relation is established as shown in FIG. 11A, as can be understood from the explanations of FIG. 10, the air which has entered the air port 37 is returned from the hole 50, which is communicated with the atmosphere, and supplied to neither the air port 39 nor the air port 41.

Next, in the case where the main rotor 25 is rotated clockwise by the angle 90., the positional relation between the disks 32, 31 and the sensors 33, 34 and the positional relation between the cutout portions 45, 47 and the air ports 37, 39, 41 are changed as shown by (b). In this state, the air port 37 and the air port 39 are not completely communicated with each other yet.

As shown in FIG. 11C, when the sensor 34 comes to a position opposing to the cutout portion 31*a*, the main rotor 25 is controlled so that it can be rotated by the angle 135.. Therefore, the device is set in the operation mode A. That is, the air port 37 and the air port 39 are communicated with each other, and the air which has entered from the air port 37 is supplied to the air port 39. However, while the main rotor 25 is rotating clockwise from the neutral position, the cutout portion 47 of the subrotor is kept being fixed. Therefore, no air is supplied to the air ports 43, 44.

Figure 11D:
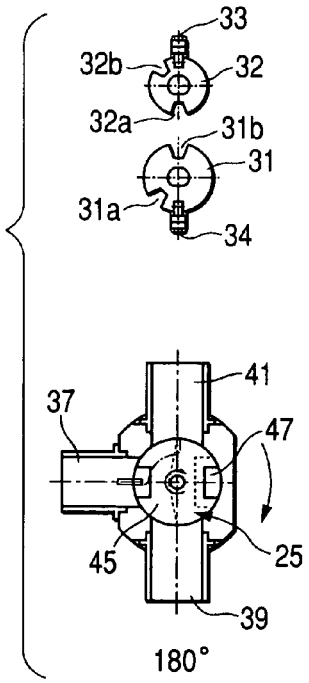
FIGS. 11D to 11F are schematic illustrations for explaining an operation mode of the distributing device used for the embodiment of the present invention.
Figure 11E:
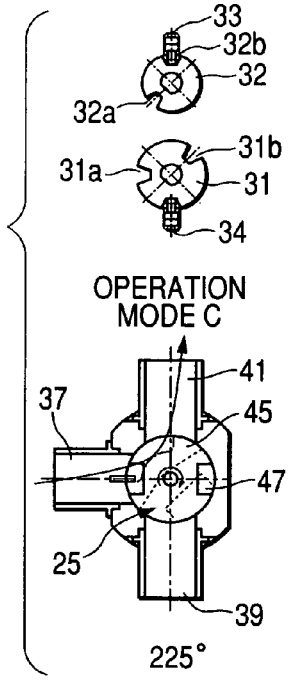
Figure 11F:
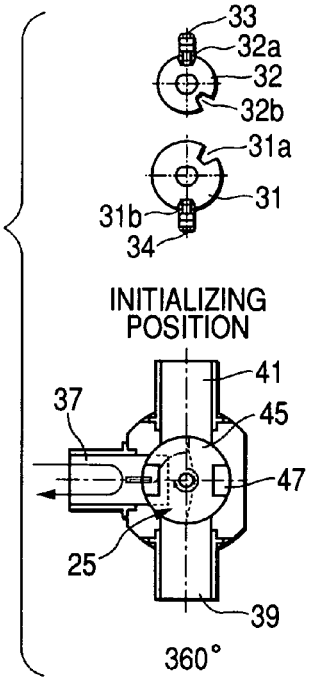

Further, when the main rotor 25 is rotated clockwise by the angle 180., the positional relation is set as shown in FIG. 11D. Therefore, the air port 37 is communicated with neither the air port 39 nor the air port 41. When the sensor 33 comes to a position opposing to the cutout portion 32*b* as shown in FIG. 11E, the main rotor 25 is controlled so that the main rotor 25 can be rotated clockwise by the angle 225.. Therefore, the device is set in the operation mode C. That is, the air port 37 and the air port 41 are communicated with each other by the cutout portion 45, and the air which has entered from the air port 37 is supplied to the air port 41. When the main rotor 25 is rotated by the angle 360., the device is set in the positional relation shown in FIG. 11F. Therefore, the device is set in the same neutral state as that shown in FIG. 11A.

Figure 12A:
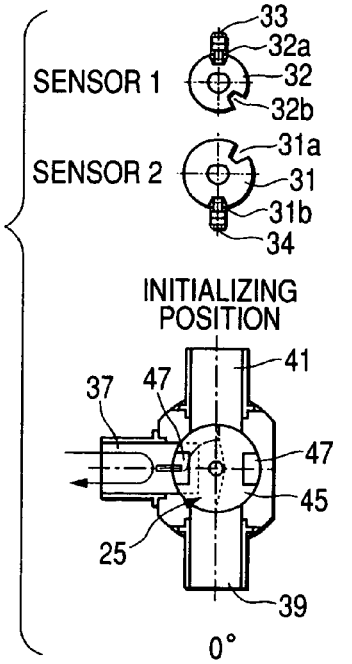
FIGS. 12A to 12C are schematic illustrations for explaining an operation mode of the distributing device used for the embodiment of the present invention.

Next, explanations will be made into a case in which the main rotor 25 is rotated counterclockwise from the neutral position shown in FIG. 12A.

Figure 12B:
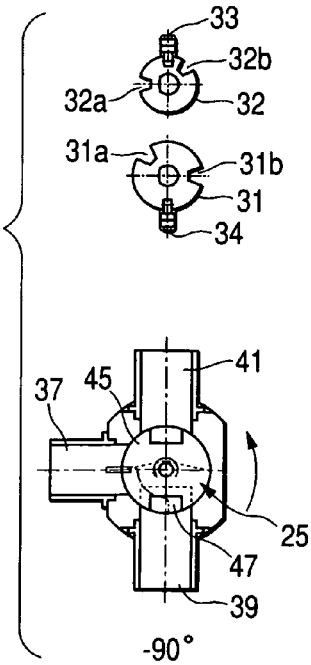

When the main rotor 25 is rotated counterclockwise by the angle 90., as shown in FIG. 12B, the cutout portions 47 of the subrotor are also rotated counterclockwise and come to positions where the cutout portions 47 are opposed to the air ports 43, 44 (shown in FIGS. 7 and 9).

However, in the state shown in FIG. 12B, the air port 37 and the air port 41 are not completely communicated with each other by the cutout portion 45 of the main rotor 25. Therefore, the air which has entered from the air port 37 is not supplied to any of the air ports 37, 41, 43 and 44.

Figure 12C:
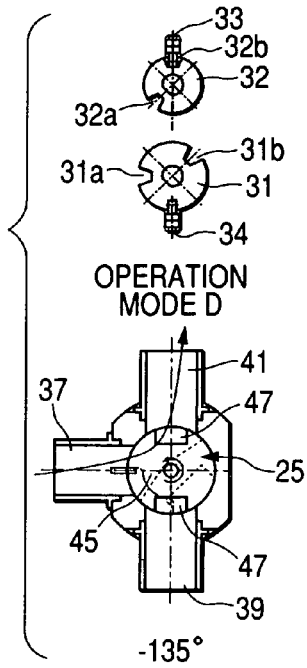

When the cutout portion 32*b* of the disk 32 comes to a position opposing to the sensor 33 as shown in FIG. 12*c*, the main rotor 25 is controlled being rotated counterclockwise by the angle 135., and the device is set at the operation mode D.

In this state, the air which has entered from the air port 37 is supplied to the air port 41 and also supplied to the air port 44 on the same side as the air port 41 via the cutout portion 47 of the subrotor.

Figure 12D:
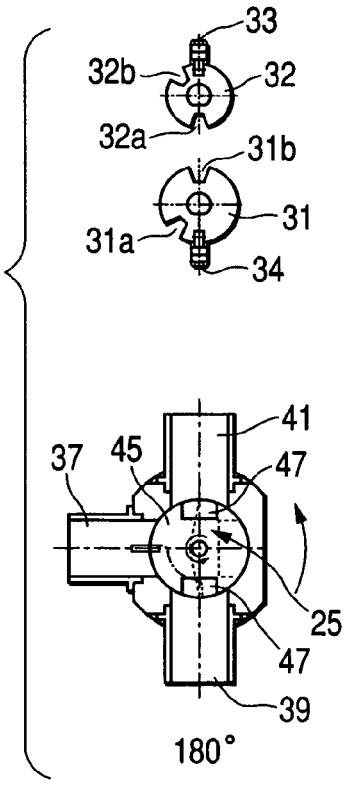
FIGS. 12D to 12F are schematic illustrations for explaining an operation mode of the distributing device used for the embodiment of the present invention.
Figure 12E:
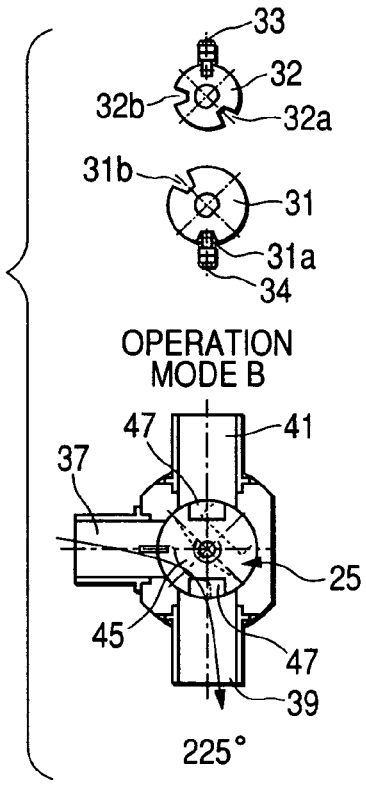
Figure 12F:
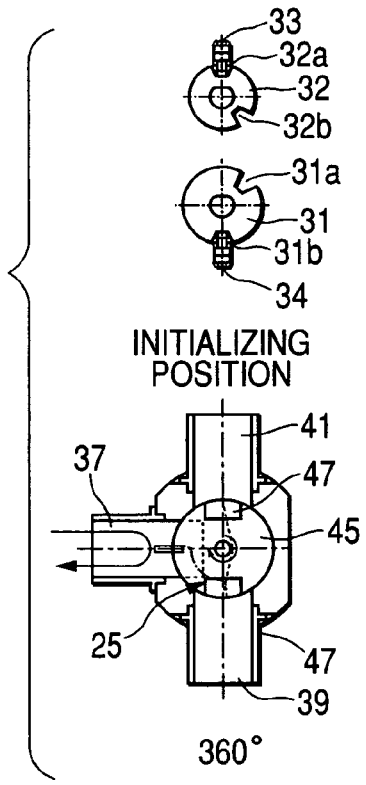

When the main rotor 25 is further rotated counterclockwise, after the device passes through the positional relation shown in FIG. 12D, the device is set in the state of the operation mode B shown in FIG. 12E. That is, when the sensor 34 comes to a position opposing to the cutout portion 31*a* of the disk 31, the main rotor 25 is controlled being rotated counterclockwise by the angle 225., and the device is set in the positional relation shown in FIG. 12E. In this state, the air which has entered from the air port 37 is supplied to the air port 39 and also supplied to the air port 43, which is provided on the same side as the air port 39, via the cutout portion 47 of the subrotor. When the main rotor 25 is rotated counterclockwise by the angle 360., the device is returned to the neutral position shown in FIG. 12F.

In the above explanations, the positional relation between the sensors 33, 34 and the cutout portions of the disks 32, 31 in the operation mode A shown in FIG. 11C and the positional relation between the sensors 33, 34 and the cutout portions of the disks 32, 31 in the operation mode B shown in FIG. 12E are the same. However, between the state shown in FIG. 11C and the state shown in FIG. 12E, the neutral position is surely interposed. Therefore, when it is distinguished whether the rotation from the neutral position is clockwise or counterclockwise, even if the sensor position is the same, it is possible to realize a different operation mode. The same thing can be said between the operation mode C and the operation mode D.

An embodiment of the present invention has been explained above. However, it is clear that variations can be made without departing from the basic concept of the present invention. It should be noted that the variations are included in the scope of the present invention.

INDUSTRIAL APPLICABILITY

The present invention can be applied to the use in which the paper supplying devices are used being switched over when necessary in an electrophotographic apparatus having a plurality of paper supplying devices. The present invention can be also applied to the use in which the injection nozzles to be used are switched over in an electrophotographic apparatus having a paper supplying device provided with a plurality of air current injection nozzles.

What is claimed is:

1. A pneumatic type paper feeding apparatus which supplies sheets of paper for printing to an electrophotographic apparatus, comprising:

a paper floating member having a first injection nozzle and a second injection nozzle for respectively injecting a current of air to the sheets of paper from different places so as to convey the sheets of paper;

a conveyance member that conveys the floated sheets of paper; and a distributing member provided in an air supply passage, that supplies a current of air to the first and the second injection nozzle, the distributing member including:

a cylindrical member, including:

a first air port communicated with the air supply passage;

a second air port communicated with a passage connected to the first injection nozzle; and a third air port communicated with a passage connected to the second injection nozzle; and a rotor pivotally inserted into the cylindrical member, the rotor operable in an operation mode comprising a first operation mode and a second operation mode according to a rotary position of the rotor, wherein in said first operation mode, the first air port is communicated with the second air port, wherein in said second operation mode, the first air port is communicated with both the second and the third air port, wherein in said first operation mode, the first air port is communicated with only the second air port, and in said second operation mode, the first air port is communicated with only the third air port;

a third operation mode in which the first air port is communicated with the second and a fourth air port; and a fourth operation mode in which the first air port is communicated with the third and a fifth air port, wherein the first to the fourth mode can be selectively changed over.

2. The pneumatic type paper feeding apparatus which supplies sheets of paper for printing to an electrophotographic apparatus according to claim 1, further comprising:

an intermediate mode, in which the first air port and the atmosphere are communicated with each other, and which is formed between at least two modes of the first to the fourth operation mode.

3. A pneumatic type paper feeding apparatus which supplies sheets of paper for printing to an electrophotographic apparatus, comprising:

a paper floating member having a first injection nozzle and a second injection nozzle for respectively injecting a current of air to the sheets of paper from different places so as to convey the sheets of paper;

a conveyance member that conveys the floated sheets of paper; and a distributing member provided in an air supply passage, that supplies a current of air to the first and the second injection nozzle, the distrubuting member including:

a cylindrical member, including:

a first air port communicated with the air supply passage;

a second air port communicated with a passage connected to the first injection nozzle; and a third air port communicated with a passage connected to the second injection nozzle; and a rotor pivotally inserted into the cylindrical member, the rotor operable in an operation mode comprising a first operation mode and a second operation mode according to a rotary position of the rotor, wherein in said first operation mode, the first air port is communicated with the second air port, wherein in said second operation mode, the first air port is communicated with both the second and the third air port, wherein the rotor comprises a main rotor and a subrotor each comprising a cutout portion, wherein the cylindrical member further includes a fourth air port and a fifth air port communicated with an injection port of the current of air, and wherein the cutout portion of the subrotor selectively communicates the first air port with at least one of the fourth air port and the fifth air port according to the rotary position of the subrotor.

4. The pneumatic type paper feeding apparatus which supplies sheets of paper for printing to an electrophotographic apparatus according to claim 3, wherein the cutout portion of the main rotor selectively communicates the first air port with at least one of the second air port and the third air port according to the rotary position of the main rotor, and wherein the cutout portion of the subrotor selectively communicates the first air port with at least one of the fourth air port and the fifth air port through a hole on a side of the main rotor according to the rotary position of the subrotor.

5. The pneumatic type paper feeding apparatus which supplies sheets of paper for printing to an electrophotographic apparatus according to claim 3, wherein the main rotor and the subrotor are connected with each other by a torque limiter, and wherein the subrotor is idled when the main rotor is rotated by an angle not less than a predetermined angle.

6. The pneumatic type paper feeding apparatus which supplies sheets of paper for printing to an electrophotographic apparatus according to claim 3, wherein the subrotor can be rotated only by a predetermined angle range when a groove is formed on the side of the subrotor by a predetermined angle range and a member engaged with the groove is provided in the cylindrical member.

* * * * *